US008393255B2

(12) United States Patent
Fuisz et al.

(10) Patent No.: US 8,393,255 B2
(45) Date of Patent: Mar. 12, 2013

(54) POUCH CUTTER

(75) Inventors: Richard C. Fuisz, McLean, VA (US); Joseph M. Fuisz, Washington, DC (US)

(73) Assignee: MonoSol Rx, LLC, Portage, IN (US)

( * ) Notice: Subject to any disclaimer, the term of this patent is extended or adjusted under 35 U.S.C. 154(b) by 489 days.

(21) Appl. No.: 11/804,385

(22) Filed: May 18, 2007

(65) Prior Publication Data

US 2007/0267433 A1 Nov. 22, 2007

Related U.S. Application Data

(60) Provisional application No. 60/801,907, filed on May 19, 2006, provisional application No. 60/922,601, filed on Apr. 10, 2007.

(51) Int. Cl.
*B26D 5/08* (2006.01)

(52) U.S. Cl. ..... 83/614; 83/613; 83/636

(58) Field of Classification Search ..... 83/614, 83/624, 455, 469, 821, 613, 636; 206/535, 206/1.5, 570, 572
See application file for complete search history.

(56) References Cited

U.S. PATENT DOCUMENTS

| | | | | | |
|---|---|---|---|---|---|
| 1,827,354 | A | | 10/1931 | Cooper | |
| 3,044,338 | A | * | 7/1962 | Horton et al. | 83/649 |
| 3,142,217 | A | * | 7/1964 | Busse | 83/375 |
| 3,189,174 | A | | 6/1965 | Cormack | |
| 3,324,754 | A | | 6/1967 | Peavy | |
| 3,370,497 | A | * | 2/1968 | Busse | 83/455 |
| 3,419,137 | A | | 12/1968 | Walck, III | |
| 3,768,725 | A | * | 10/1973 | Pilaro | 206/439 |
| 3,809,220 | A | | 5/1974 | Arcudi | |
| 4,170,300 | A | * | 10/1979 | Pick | 206/365 |
| 4,219,116 | A | * | 8/1980 | Borkan | 206/1.5 |
| 4,762,230 | A | | 8/1988 | Croce | |
| 4,781,294 | A | | 11/1988 | Croce | |
| 4,851,394 | A | | 7/1989 | Kubodera | |
| 4,993,586 | A | * | 2/1991 | Taulbee et al. | 221/25 |
| 5,025,692 | A | * | 6/1991 | Reynolds | 83/468 |
| 5,044,241 | A | * | 9/1991 | Labrecque | 83/489 |
| 5,107,734 | A | * | 4/1992 | Armbruster | 83/205 |
| 5,354,551 | A | | 10/1994 | Schmidt | |
| 5,411,945 | A | | 5/1995 | Ozaki et al. | |
| 5,518,902 | A | | 5/1996 | Ozaki et al. | |
| 5,613,779 | A | | 3/1997 | Niwa | |
| 5,641,093 | A | | 6/1997 | Dolin et al. | |
| 5,945,651 | A | * | 8/1999 | Chorosinski et al. | 235/375 |

(Continued)

FOREIGN PATENT DOCUMENTS

| | | | |
|---|---|---|---|
| DE | 20 2005 004 916 | U1 | 6/2005 |
| EP | 1 852 041 | A2 | 11/2007 |

(Continued)

OTHER PUBLICATIONS

"S.C. Johnson debuts cutter for new Saran film", A. Orloski, www.packworld.com, 2004, 2 pages.

(Continued)

*Primary Examiner* — Sean Michalski
(74) *Attorney, Agent, or Firm* — Hoffmann & Baron, LLP

(57) ABSTRACT

The dispenser assembly is for opening a pouch or packet structure. The dispenser assembly includes a container structure having an interior cavity. The cavity has a sufficient dimension such that the packet structure may be stored therein. The dispenser assembly includes a cutter for severing the pouch or packet structure. The cutter is secured to or removably stored in the container. The cutter may be constituted by a slider structure, guillotine cutter, or U-shaped member.

8 Claims, 11 Drawing Sheets

U.S. PATENT DOCUMENTS

| | | | | |
|---|---|---|---|---|
| 6,070,591 | A * | 6/2000 | Bryer | 131/233 |
| 6,148,708 | A * | 11/2000 | Pfeiffer | 83/628 |
| 6,152,007 | A * | 11/2000 | Sato | 83/582 |
| 6,230,894 | B1 | 5/2001 | Danville | |
| 6,311,627 | B1 * | 11/2001 | Draper et al. | 108/50.11 |
| 6,338,407 | B2 | 1/2002 | Danville | |
| 6,374,715 | B1 * | 4/2002 | Takatsuka | 83/620 |
| 6,468,516 | B1 * | 10/2002 | Geria et al. | 424/73 |
| 6,708,826 | B1 | 3/2004 | Ginsberg et al. | |
| 6,929,399 | B2 | 8/2005 | Nokura | |
| 7,428,859 | B2 * | 9/2008 | Fujita et al. | 83/456 |
| 7,694,617 | B2 * | 4/2010 | Habra et al. | 83/578 |
| 7,854,890 | B2 * | 12/2010 | Matsumoto et al. | 422/63 |
| 2002/0104774 | A1 | 8/2002 | Hammond | |
| 2003/0121932 | A1 | 7/2003 | Wajda | |
| 2003/0140760 | A1 * | 7/2003 | Bory | 83/614 |
| 2003/0183643 | A1 | 10/2003 | Fagen et al. | |
| 2005/0035133 | A1 * | 2/2005 | Gerulski et al. | 221/31 |
| 2006/0023976 | A1 | 2/2006 | Alvater et al. | |
| 2006/0180604 | A1 | 8/2006 | Ginsberg et al. | |
| 2007/0228053 | A1 * | 10/2007 | Darst | 220/694 |
| 2008/0268116 | A1 * | 10/2008 | Kring | 426/411 |
| 2008/0289189 | A1 * | 11/2008 | Khatchadourian | 30/125 |
| 2011/0070633 | A1 * | 3/2011 | Matsumoto et al. | 435/287.1 |
| 2012/0240742 | A1 * | 9/2012 | Anderson et al. | 83/438 |

FOREIGN PATENT DOCUMENTS

| | | |
|---|---|---|
| JP | 11-255247 | 9/1999 |
| JP | 2001-225851 | 8/2001 |
| JP | 2003-312688 | 11/2003 |
| WO | WO 02/091965 A1 | 11/2002 |
| WO | WO 2006/017462 | 2/2006 |
| WO | WO 2006/085210 A1 | 8/2006 |

OTHER PUBLICATIONS

"Sudafed & Sudafed PE™ Quick-Dissolve Strips", Box of 10 strips, McNeil-PPC, Inc., www.sudafed.com, 2005-2007, 2 pages.

Trademark Registration No. 2,944,841 for "Slide Cutter Sold as an Integral Component of Plastic Wrap, Aluminum Foil and Wax Paper Dispensers", Reynolds Metals Co., Registered Apr. 26, 2005, 1 page.

PCT Notification of Transmittal of the International Search Report and the Written Opinion of the International Searching Authority or the Declaration for International Application No. PCT/US2007/012200, Mar. 6, 2008( 2 pages).

PCT International Search Report for International Application No. PCT/US2007/012200, Mar. 6, 2008 (7 pages).

PCT Written Opinion of the International Searching Authority for International Application No. PCT/US2007/012200, Mar. 6, 2008 (11 pages).

Anonymous: "Verbandkasten" Internet Article, [Online] May 18, 2005, XP002459018 Retrieved from the Internet: URL:http://web.archive.org/web/20050518105251/http://de.wikipedia.org/wiki/Verbandkasten> [retrieved on Nov. 19, 2007].

PCT Invitation to Pay Additional Fees for International Application No. PCT/US2007/012200, Dec. 14, 2007 (Form PCT/ISA/206, 1 Page).

ISA finding of multiple inventions for International Application No. PCT/US2007/012200, Dec. 14, 2007 (Form PCT/ISA/206 (extra sheets), 2 Pages).

PCT Partial International Search Report for International Application No. PCT/US2007/012200, Dec. 14, 2007 (Form PCT/ISA/206 (Annex, patent family annex), 3 Pages).

* cited by examiner

POUCH CUTTER

CROSS-REFERENCE TO RELATED APPLICATIONS

This patent application claims priority to and the benefit of U.S. Provisional Patent Application No. 60/801,907 filed May 19, 2006, and U.S. Provisional Patent Application No. 60/922,601 filed Apr. 10, 2007, all of which are hereby incorporated by reference herein.

FIELD OF THE INVENTION

The present invention relates generally to a pouch cutter and, more specifically, to a cutter and a container in which are stored pouches or packets which contain film strips. The cutter is secured to or removably stored in the container.

BACKGROUND OF THE INVENTION

Pharmaceuticals and similar substances are typically required to be ingested in relatively precise amounts. One technique for providing pharmaceuticals in such relatively precise amounts for ingestion is to impregnate a dissolvable film strip with the relatively precise amount of the pharmaceutical. The user may then place the film strip in their mouth and receive the relatively precise amount of the pharmaceutical.

Medications are frequently applied to cuts and wounds to facilitate the healing thereof. One technique for applying such medications to cuts and wounds on the skin is to impregnate a film strip with the medication. The user may then place the film strip on the cut or wound and, frequently, the adjacent skin, such that the medication on the film strip is transferred to the cut or wound. The film strip may be dissolvable or removed after the medication has been transferred to the cut or wound.

Such impregnated film strips may be contained within a pouch or packet for storage before ingestion or application by the user. Such pouches or packets provide protection to the film strip and maintain the pharmaceutical or medication in a controlled environment before ingestion or application thereof by the user.

The pouches or packets are typically opened by the user manually tearing the pouch or packet to gain access to the film strip therein. Preferably, the tearing force and manual dexterity required to open the pouches or packets by tearing is limited such that the pouches or packets may be readily opened. This feature of the pouches or packets is particularly advantageous when the pouches or packets are to be used by persons with limited manual strength and dexterity. Such limited manual strength and dexterity may be present in elderly persons, especially those who suffer from arthritis. Also, such limited manual strength and dexterity may be present in people of all ages who have, for example, suffered an injury to their hands, undergone surgery, or other detrimental medical conditions.

Another aspect of the use of the pouches or packets makes it preferable for the pouches or packets to be difficult to open. This aspect relates to child-resistance and, more specifically, the desirability that the pouches or packets be difficult for a child to open. Providing the pouches or packets with this feature reduces the likelihood of children gaining access to the film strips within the pouches or packets. Frequently, the pharmaceuticals or other substances of which the film strips are impregnated are preferably not accessible directly by children. This is a consequence of the proper use of such pharmaceuticals or other substances normally being beyond the capabilities of children.

The desirability of making the pouches or packets child resistant may result in the pouches or packets being difficult to open by an adult having limited manual strength or dexterity. Consequently, the configuration and fabrication of the pouches or packets may be difficult.

SUMMARY OF THE INVENTION

The dispenser assembly of the present invention is for opening a pouch or packet structure. The dispenser assembly includes a container structure having an interior cavity. The cavity has a sufficient dimension such that the packet structure may be stored therein. The dispenser assembly includes a cutter for severing the pouch or packet structure. The cutter is secured to or removably stored in the container. The cutter may be constituted by a slider structure, guillotine cutter, or U-shaped member.

The cutter may readily sever a pouch or packet structure which is otherwise difficult to open by the manual tearing thereof. Consequently, the pouch or packet structure may be sufficiently difficult to open by a child to satisfy the requirements of child-resistance. The cutter may also be configured to be difficult to operate by a child to further provide child-resistance. The cutter, however, may be configured to be readily operable by an adult, including adults who have limited manual strength and dexterity, to sever the pouch or packet structure to gain access to the film strip contained therein. Accordingly, the dispenser assembly provides child-resistance while allowing adults who have limited manual strength and dexterity to readily open the pouch or packet structure.

These and other features of the invention will be more fully understood from the following description of specific embodiments of the invention taken together with the accompanying drawings.

BRIEF DESCRIPTION OF THE DRAWINGS

In the drawings.

Corresponding reference characters indicate corresponding parts throughout the several views of the drawings.

DETAILED DESCRIPTION OF THE INVENTION

Figure 1:
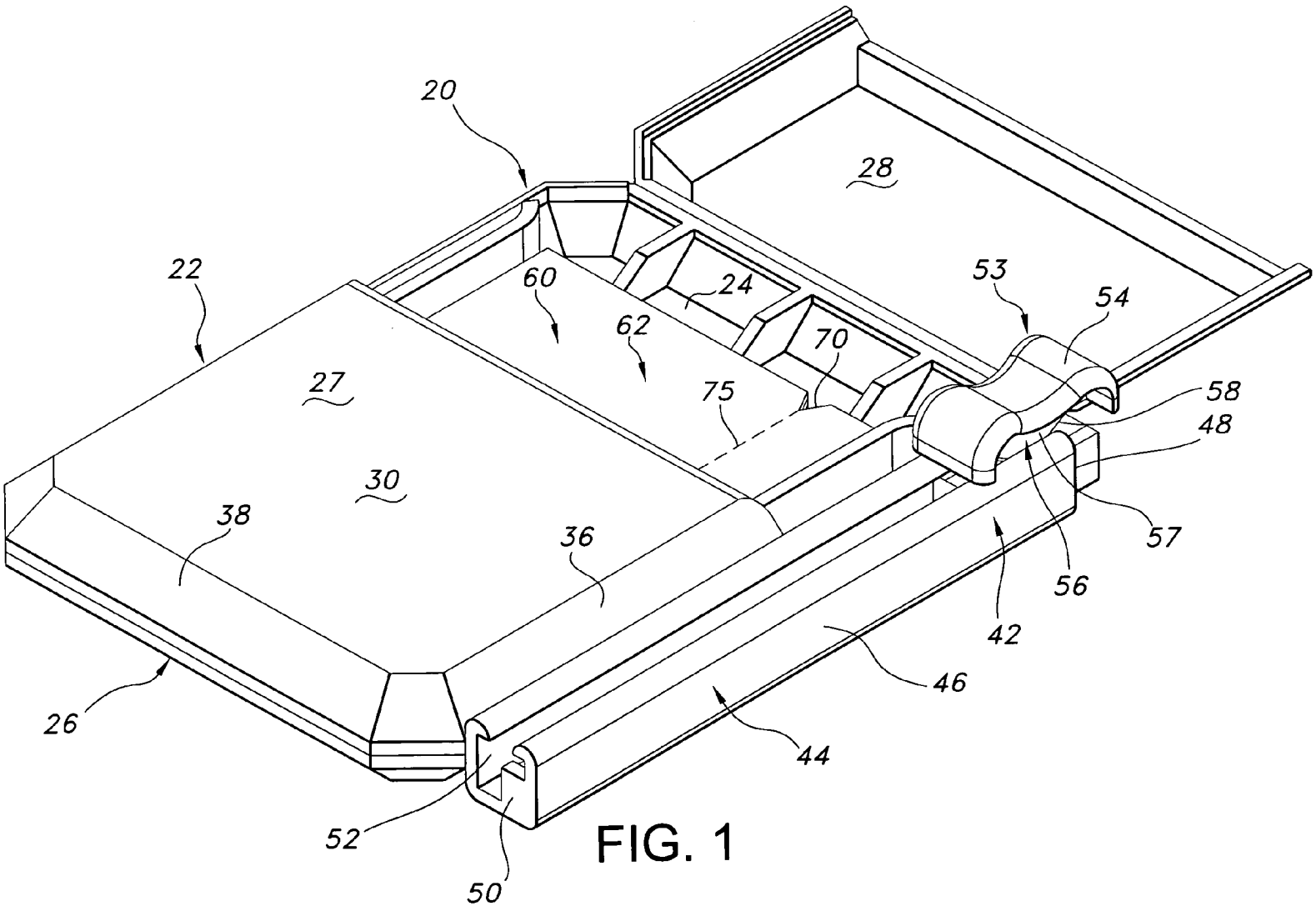
FIG. 1 is a perspective view of the dispenser assembly of the present invention, the dispenser assembly being shown as having a container structure in which are stored packet structures which contain strip structures.
Figure 2:
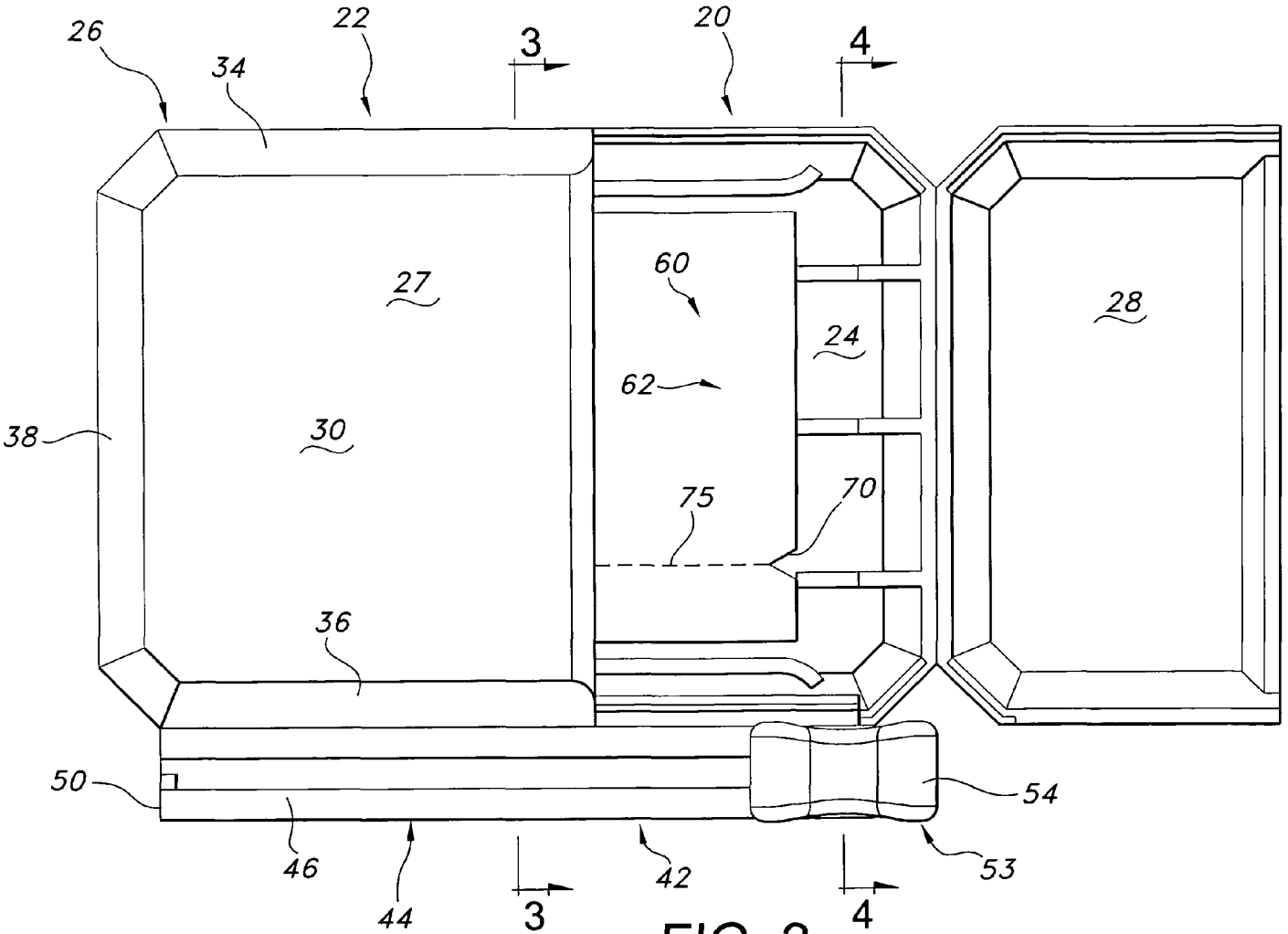
FIG. 2 is a front view of the dispenser assembly of FIG. 1.
Figure 4:
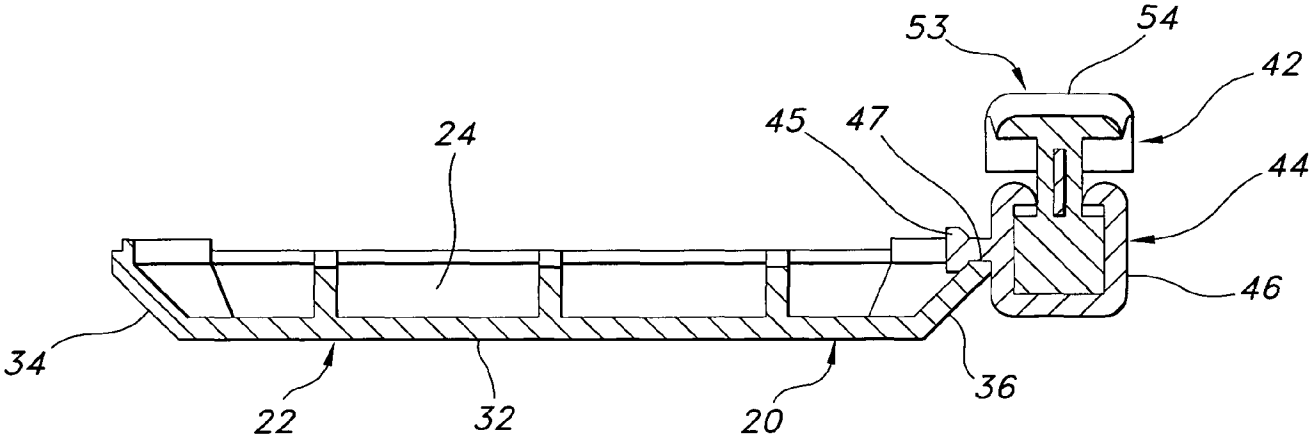
FIG. 4 is a transverse cross sectional view in the plane indicated by line 4-4 of FIG. 2 of the dispenser assembly showing the slider structure of the cutter assembly.
Figure 3:
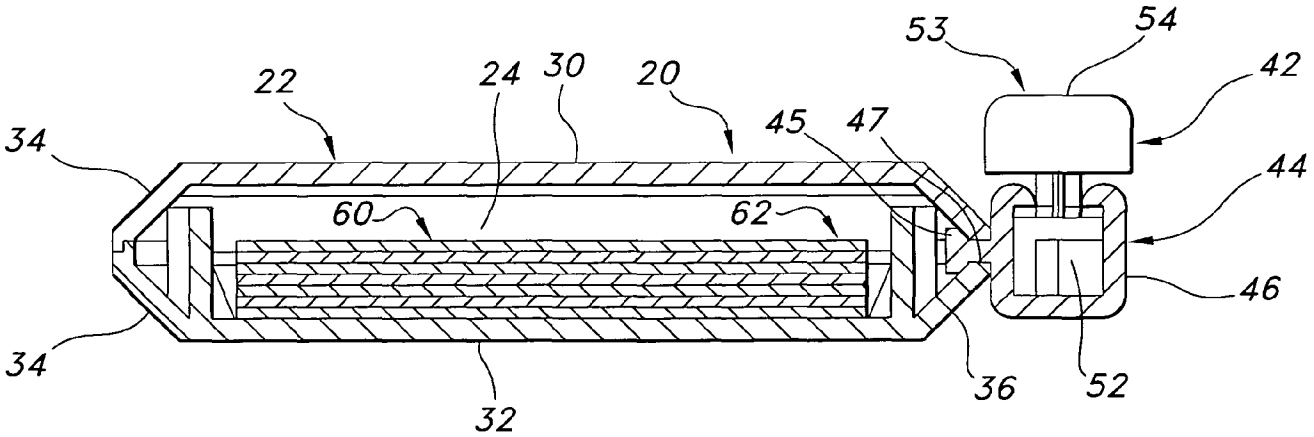
FIG. 3 is a transverse cross sectional view in the plane indicated by line 3-3 of FIG. 2 of the dispenser assembly showing the cutter assembly thereof.

Referring to the drawings and more specifically to FIGS. 1 and 2, the dispenser assembly 20 includes a container structure 22 having an interior cavity 24. The container structure 22 includes a body structure 26 having an outer surface 27. The cavity 24 is located within the body structure 26. The body structure 26 has a front surface 30, a rear surface 32, two pairs of side surfaces 34, 36, and a pair of bottom surfaces 38.

The container structure 22 has a cap structure 28 which is connected to the body structure 26 by a hinge structure. The hinge structure provides for the cap structure 28 to swing between open and closed positions. When the cap structure 28 is in the open position, access is provided to the cavity 24.

The connection of the cap structure 28 to the body structure 26 when the cap structure is in the closed position may provide for the container structure 22 to be child-resistant. A container structure 22 which is child-resistant would normally prevent children from moving the cap structure 28 from the closed position to the open position.

The dispenser assembly 20 includes a cutter structure which is defined by a cutter assembly 42 having a support structure 44. The support structure 44 includes an elongate channel member 46 which has opposite ends 48, 50. The support structure 44 has an elongate cavity 52 within the channel member 46. The support structure 44 includes a tongue member 45 which is integral with the channel member 46. The tongue member 45 extends into a groove 47 which is between the side surfaces 36. The tongue and channel members 45, 46 are secured to the side surfaces 36, such as by acrylate or heat welding. The extension of the tongue member 45 into the groove 47 and connection of the tongue member to the side surfaces 36 defines a tongue and groove connection. The groove 47 may have a width which narrows at the ends of the groove to obstruct longitudinal translation of the tongue member 45 relative to the side surfaces 36. The ends of the groove 47 may be closed to further obstruct such longitudinal translation of the tongue member 45.

The cutter assembly 42 has a slider structure 53 which includes a tab structure 54 and a blade structure 56 which is connected thereto. The blade structure 56 has an annular body 57 the outer edge 58 of which is sharpened for cutting. It is possible for the connection of the blade structure 56 to the tab structure 54 to provide for rotation of the annular body 57 relative to the tab structure.

The tab structure 54 is mounted on the channel member 46 such that the blade structure 56 extends into the cavity 52. The connection of the tab structure 54 to the channel member 46 provides for the translation of the slider structure 53 relative to the support structure 44 between the ends 48, 50.

The dispenser assembly 20 is included in a kit which includes one or more pouches or packet structures 60 which are stored in the cavity 24. The cavity 24 has a sufficient dimension such that the one or more packet structures 60 may be stored therein. Each of the packet structures 60 includes an envelope structure 62 which has an interior cavity in which a strip structure is contained. Each of the packet structures 60 has opposing side layers between which the cavity of the packet structure is located. Each of the side layers has an inner liner and an outer layer which provides the packet structures 60 with a quadra-layer structure. The inner liner of the packet structures 60 may be formed of a metallic foil material.

The outer layers of the packet structures 60 are formed of a material which resists tearing by a tear force which is below a specific magnitude. The specific magnitude of the tear force is sufficiently large such that the packet structures 60 are child-resistant. The material of the outer layers of the packet structures 60 may be severed by a suitable instrument, such as the cutter assembly 42.

Figure 5:
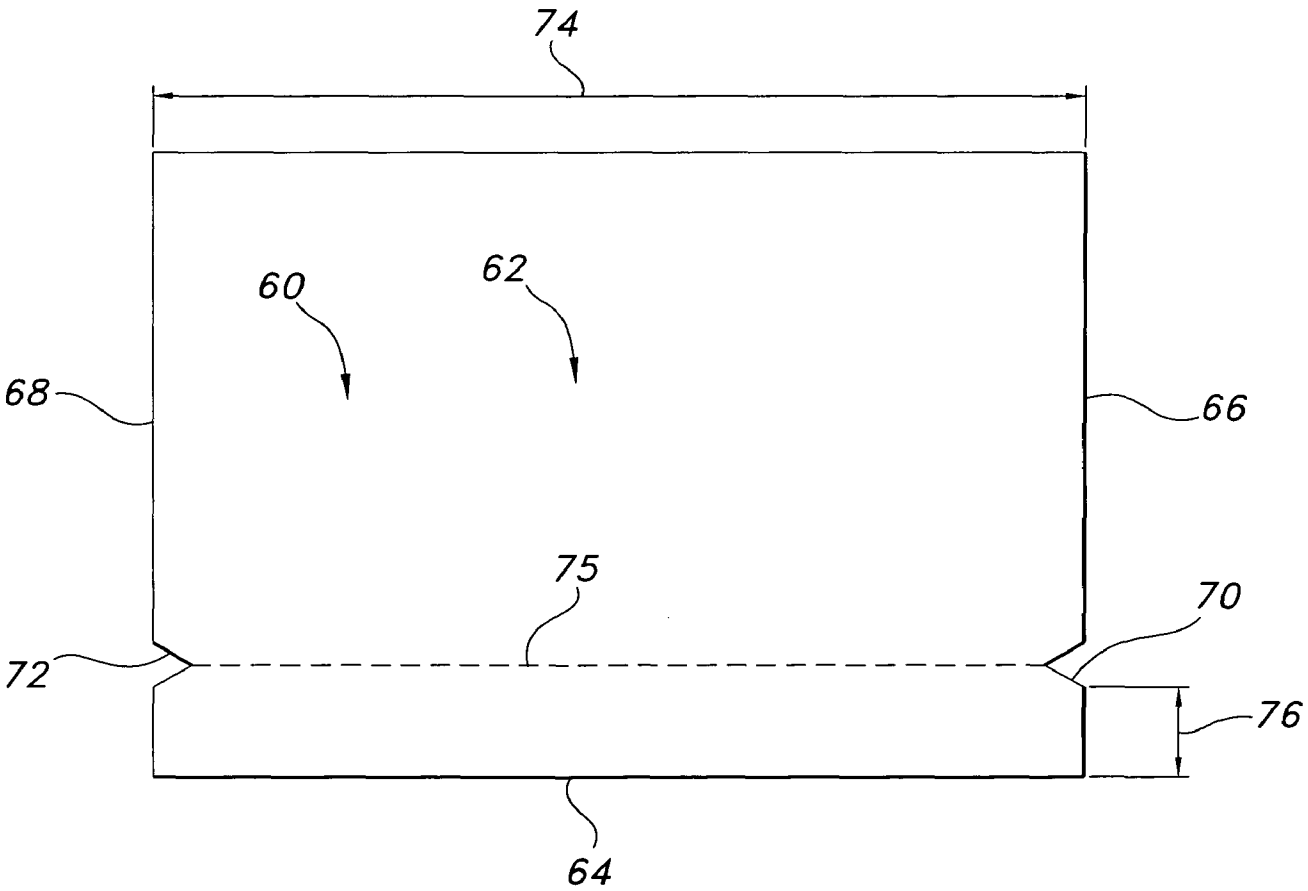
FIG. 5 is a front view of one of the packet structures located in the dispenser assembly of FIG. 1.

The envelope structure 62 has an opening edge 64 and a pair of lateral edges 66, 68 which intersect the opening edge. Each of the packet structures 60 has a locator structure connected to the envelope structure 62. The locator structure shown in FIG. 5 is defined by a pair of chevron structures 70, 72 each of which is integral with a respective one of the lateral edges 66, 68. The chevron structures 70, 72 reduce the longitudinal dimension 74 of the cavity of the corresponding packet structure 60 to a size which is smaller than the corresponding dimension of the strip structure which is stored within the packet structure 60. Consequently, the strip structure is obstructed from translating laterally within the packet structure 60 to a section 75 thereof which is between the chevron structures 70, 72. This maintains a lateral clearance between the strip structure and opening edge 64 which is at least as large as the lateral dimension 76 between each of the chevron structures 70, 72 and the opening edge.

The packet structures 60 have indicia on the outer surface of one or both of the outer layers. The indicia are located near the chevron structures 70, 72. The indicia indicate the alignment of the chevron structures 70, 72 relative to the blade structure 56 when the cutter assembly 42 is actuated.

Figure 6:
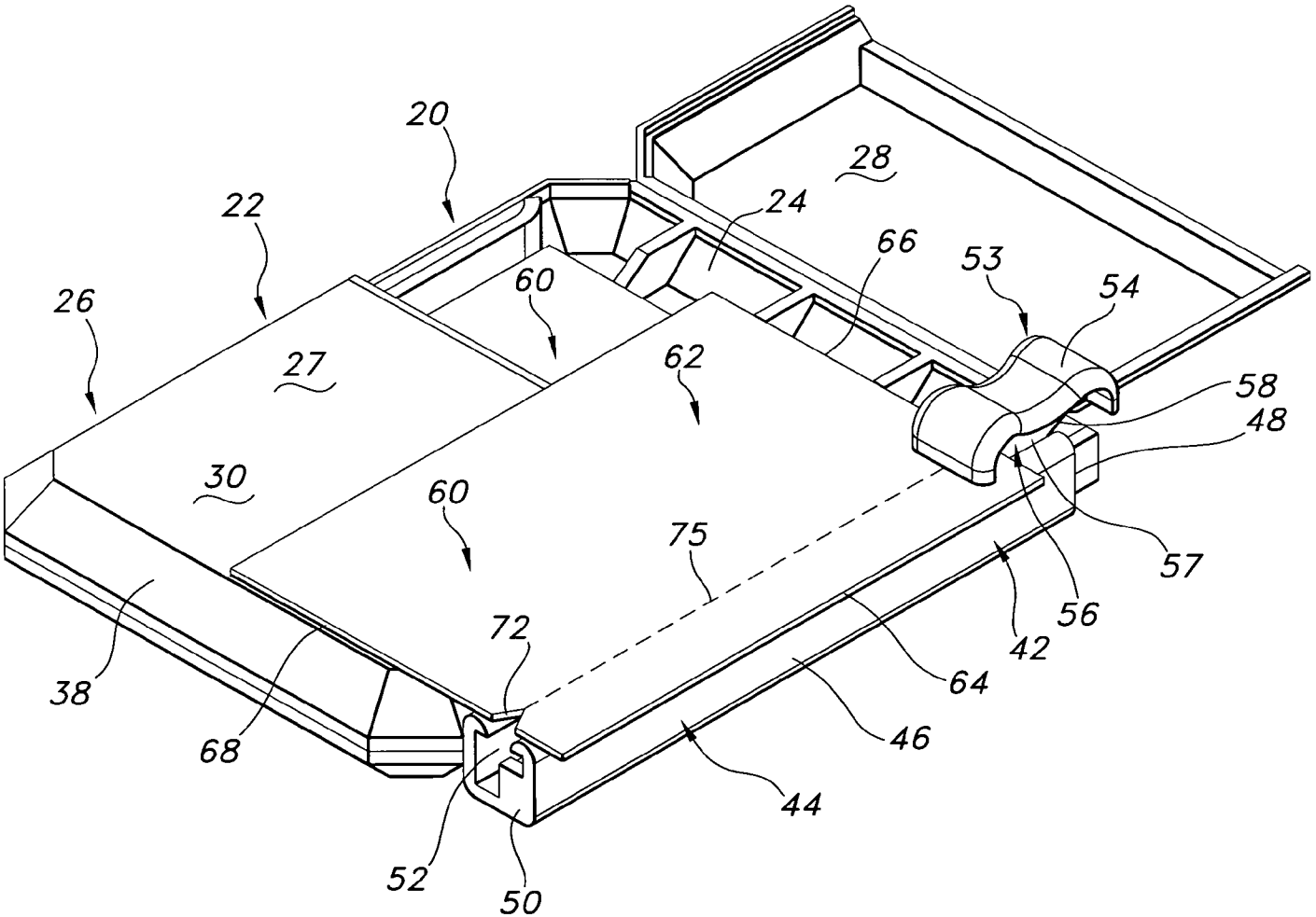
FIG. 6 is a perspective view of the dispenser assembly of FIG. 1 showing one of the packet structures positioned in the cutter assembly for severing thereof.
Figure 7:
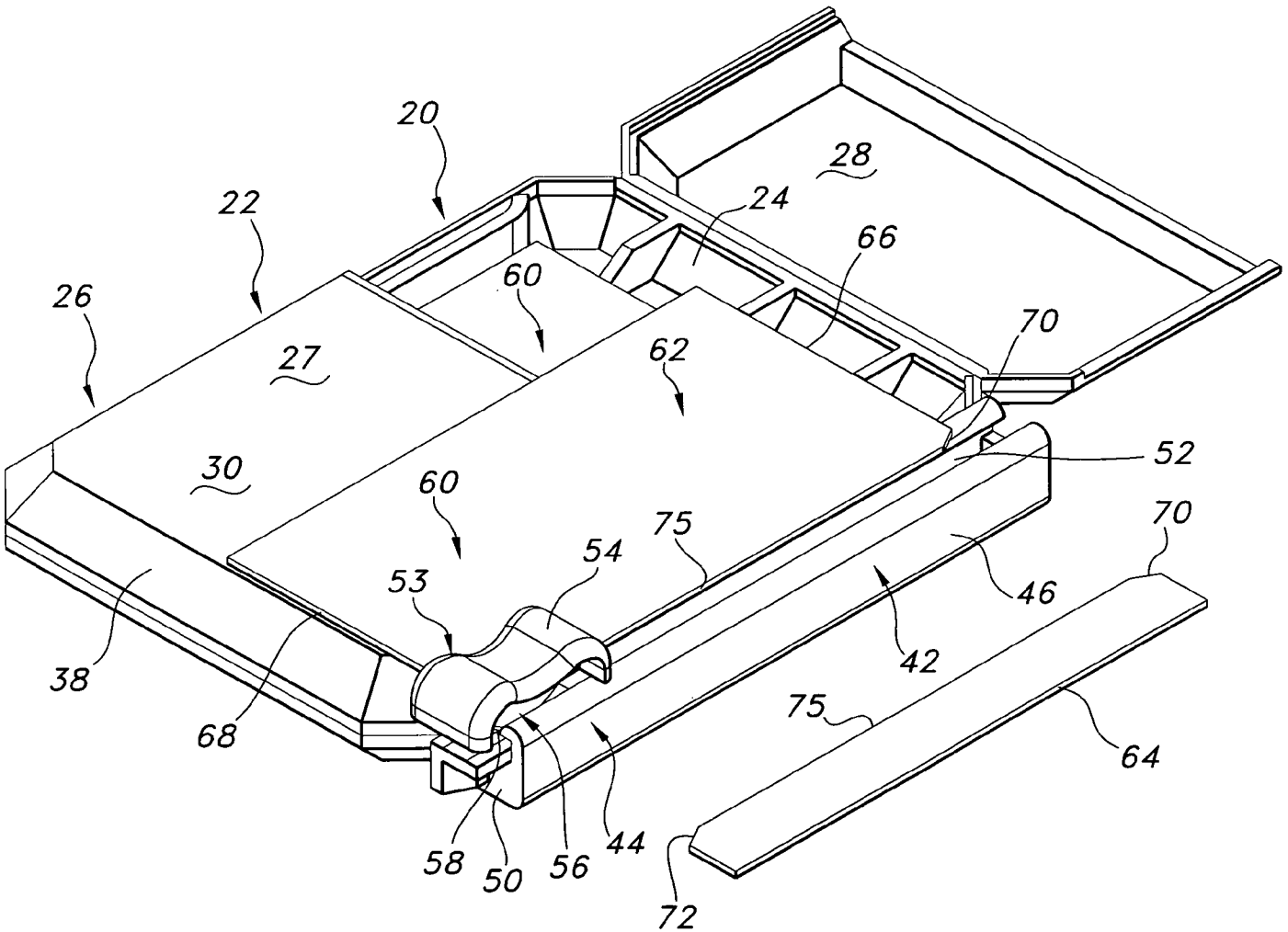
FIG. 7 is a perspective view of the dispenser assembly and packet structure of FIG. 6 following the severing of the packet structure by the cutter assembly.

The opening edge 64 is severed by the cutter assembly 42, as shown in FIG. 7, to provide access to the strip structure within the cavity of the envelope structure 62. The severing is provided by initially positioning the slider structure 53 adjacent to the end 48 of the channel member 46, as shown in FIG. 6.

The packet structure 60 is then located relative to the channel member 46 and slider structure 53, as shown in FIG. 6. In this position of the packet structure 60, the channel member 46 is located laterally between the opening edge 64 and body structure 26. This position of the packet structure 60 provides for the chevron structures 70, 72 to have substantially the same lateral positions as the blade structure 56. The indicia which are printed on the outer surface of the envelope structure 62 indicate that the packet structure 60 is positioned relative to the cutter assembly 42 such that the chevron structures 70, 72 have substantially the same lateral positions as the blade structure 56.

The slider structure 53 is then translated relative to the channel member 46 in the direction toward the end 50 such that the blade structure 56 cuts through the packet structure 60. The blade structure 56 initially contacts the chevron structure 70 as a result of the lateral position thereof being substantially the same as the blade structure. The continuation of the translation of the slider structure 53 toward the end 50 results in the blade structure 56 contacting the section 75 of the packet structure 60. This translation of the slider structure 53 severs the opening edge 64 from the packet structure 60. The severing of the opening edge 64 from the packet structure 60 is completed by the blade structure 56 cutting through the chevron structure 72. After completion of the severing, the opening edge 64 is completely separated from the packet structure 60 and the slider structure 53 is positioned adjacent to the end 50 of the channel member 46, as shown in FIG. 7.

The severing of the opening edge 64 from the packet structure 60 by the cutter assembly 42 provides for the strip structure which is within the envelope structure 62 to not be contacted by the blade structure 56. This is provided by the chevron structures 70, 72 which obstruct the strip structure from translating laterally within the packet structure 60 to the section 75 which is cut by the blade structure 56. Consequently, the chevron structures 70, 72 provide for the maintenance of a lateral clearance between the strip structure and opening edge 64 which is at least as large as the lateral dimension 76. This provides a minimum clearance between the strip structure and opening edge 64.

The cutter assembly 42 is preferably child-resistant such that children would normally be unable to sever a packet structure 60 using the cutter assembly 42. The child-resistance may be provided by configuring the cutter assembly 42 such that a child would normally be unable to properly position the packet structure 60 relative to the cutter assembly 42 as shown in FIG. 6. Also, the child-resistance may be provided by configuring the cutter assembly 42 such that a child would normally be unable to translate the slider structure 53 from the position thereof shown in FIG. 6 to the position of the slider structure shown in FIG. 7 to sever the opening edge 64 from the packet structure 60.

After the opening edge 64 is completely severed from the packet structure 60, the packet structure is removed from the cutter assembly 42 and opened to remove the strip structure from within the envelope structure 62. The strip structure is digestible and may be impregnated with a pharmaceutical substance for ingestion by the user.

In an alternative embodiment of the dispenser assembly 20, the cutter assembly 42 has a blade structure 56 which is stationary relative to the body structure 26. Such a cutter assembly may be configured to provide for the severing of the opening edge 64 from the packet structure 60 by sliding the packet structure against the outer edge 58 of the blade structure 56.

In an alternative embodiment of the dispenser assembly 20, the cutter assembly 42 may provide for the severing of the lateral edges 66, 68 from the packet structure 60.

In an alternative embodiment of the dispenser assembly 20, the support structure 44 is secured to the side surfaces 34. In a further alternative embodiment of the dispenser assembly 20, the support structure 44 is secured to the bottom surfaces 38.

In an alternative embodiment of the dispenser assembly 20, the cutter structure is defined by a laser cutter.

In an alternative embodiment of the packet structure 60, the opposing sides thereof may be homogeneous such that the packet structure is a bi-layer structure.

Figure 8:
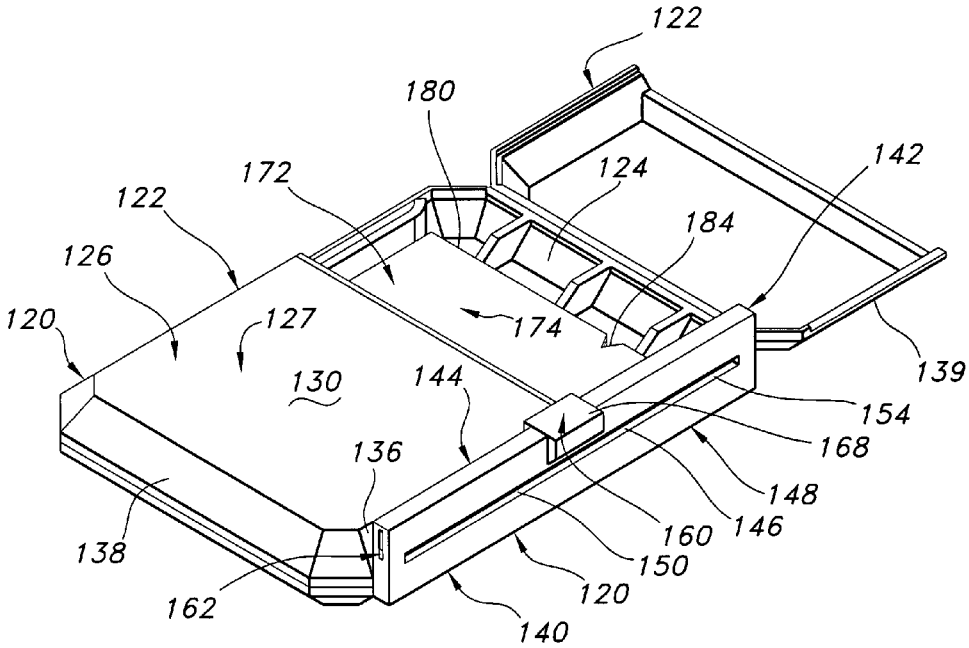
FIG. 8 is a perspective view of an alternative second embodiment of the dispenser assembly of FIG. 1, the dispenser assembly being shown as having a container structure in which are stored packet structures which contain film strips.
Figure 9:
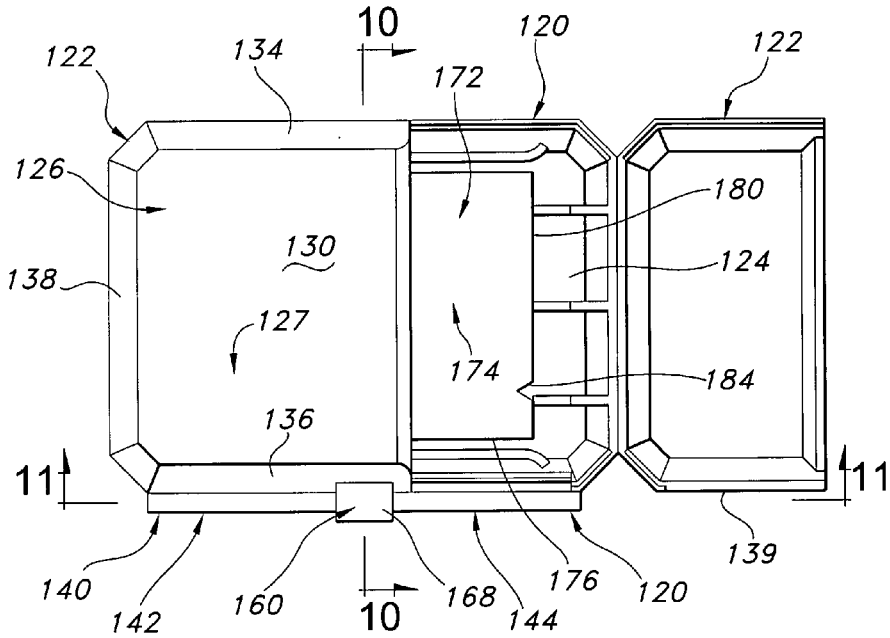
FIG. 9 is a front view of the dispenser assembly of FIG. 8.

An alternative embodiment of the dispenser assembly 120 is shown in FIGS. 8 and 9. The dispenser assembly 120 includes a container structure 122 having an interior cavity 124. The container structure 122 includes a body structure 126 having an outer surface 127. The cavity 124 is located within the body structure 126. The body structure 126 has a front surface 130, a rear surface 132, two pairs of side surfaces 134, 136, and a pair of bottom surfaces 138.

The container structure 122 has a cap structure 139 which is connected to the body structure 126 by a hinge structure. The hinge structure provides for the cap structure 139 to swing between open and closed positions. When the cap structure 139 is in the open position, access is provided to the cavity 124.

The connection of the cap structure 139 to the body structure 126 when the cap structure is in the closed position may provide for the container structure 122 to be child-resistant. A container structure 122 which is child-resistant would normally prevent children from moving the cap structure 139 from the closed position to the open position.

Figure 10:
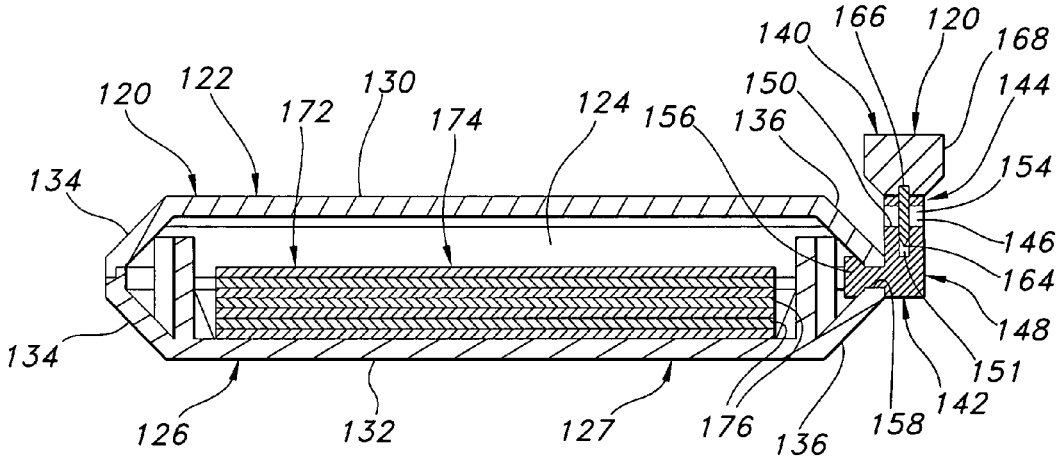
FIG. 10 is a transverse cross-sectional view in the plane indicated by line 10-10 of FIG. 9 of the dispenser assembly showing the sliding cutter thereof.

The dispenser assembly 120 includes a sliding cutter 140 which is an alternative embodiment of the cutter structure which is included in the dispenser assembly 20 shown in FIGS. 1 to 4, 6, and 7. The sliding cutter 140 has a frame structure 142 which includes a guide structure 144 and base structure 148. The base structure 148 has a planar surface which defines a cut surface 150. The cut surface 150 includes front and rear sections which are separated by a gap 151, as shown in FIG. 10. The base structure 148 and guide structure 144 are monolithic such that a clearance 154 is provided between the guide structure and base structure. The clearance 154 is elongate, as shown in FIG. 8. The front section of the clearance 154 defines an evacuation port 146. An alternative embodiment of the evacuation port 146 is provided by slits or openings which are formed in the base structure 148 and extend downward from the front and rear sections of the cut surface 150 to the bottom surface of the base structure.

The frame structure 142 includes a tongue member 156 which is integral with the base structure 148. The tongue member 156 extends into a groove 158 which is between the side surfaces 136. The tongue member 156 and base structure 148 are secured to the side surfaces 136, such as by acrylate or heat welding. The extension of the tongue member 156 into the groove 158 and connection of the tongue member to the side surfaces 136 defines a tongue and groove connection. The groove 158 may have a width which narrows at the ends of the groove to obstruct longitudinal translation of the tongue member 156 relative to the side surfaces 136. The ends of the groove 158 may be closed to further obstruct such longitudinal translation of the tongue member 156.

The sliding cutter 140 includes a cutter structure 160 having a blade structure 162 which is supported within the guide structure 144, as shown in FIGS. 8, and 13 to 15. The blade structure 162 has a cutting edge 164 which is sharpened for cutting. The blade structure 162 has a base edge 166 which is parallel to the cutting edge 164. The cutter structure 160 includes a tab structure 168 which is secured to the base edge 166.

Figure 13:
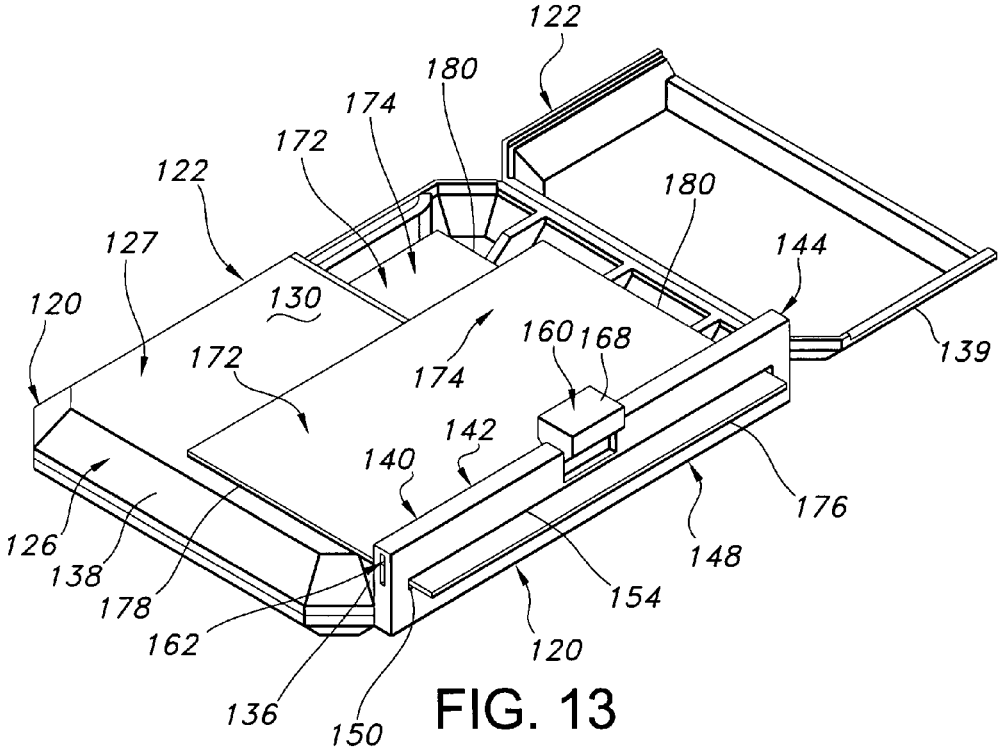
FIG. 13 is a perspective view of the dispenser assembly of FIG. 8 showing one of the packet structures positioned in the sliding cutter for severing thereof.

The support of the blade structure 162 by the guide structure 144 provides for the cutter structure 160 to be located in an open position, shown in FIG. 13, in which the cutting edge 164 is located between the base edge 166 and cut surface 150. The support by the guide structure 144 further provides for displacement of the blade structure 162 from the open position, shown in FIG. 13, to a cut position, shown in FIGS. 8 to 11, and 14. When the blade structure 162 is in the cut position, the cutting edge 164 is within the gap 151, as shown in FIGS. 10 and 11.

The support of the blade structure 162 by the guide structure 144 provides for the direction of the displacement of the blade structure between the open and cut positions to be perpendicular to the cut surface 150. Alternative embodiments of the sliding cutter 140 are possible in which the direction of the displacement of the blade structure 162 between the open and cut positions is inclined relative to the cut surface 150 such that the direction of the displacement intersects a plane which coincides with the cut surface.

Figure 11:
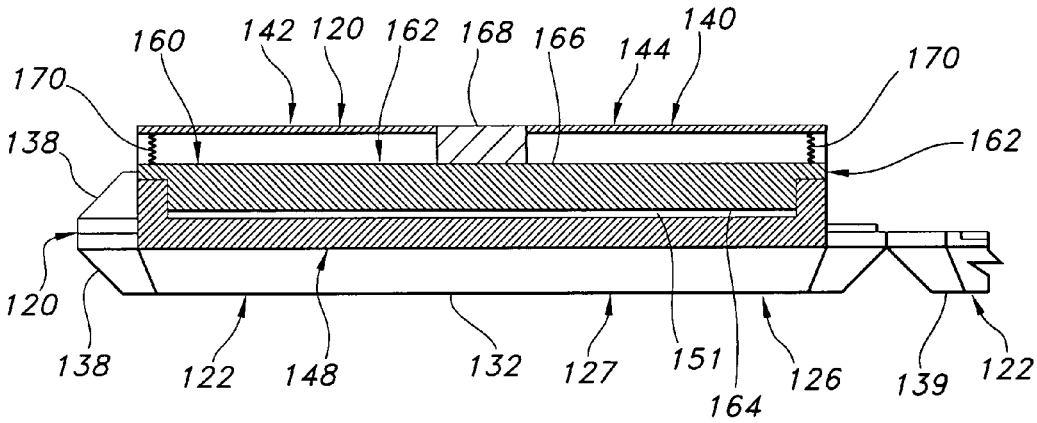
FIG. 11 is a transverse cross-sectional view in the plane indicated by line 11-11 of FIG. 9 of the dispenser assembly showing the base and cutter structures of the sliding cutter.
Figure 15:
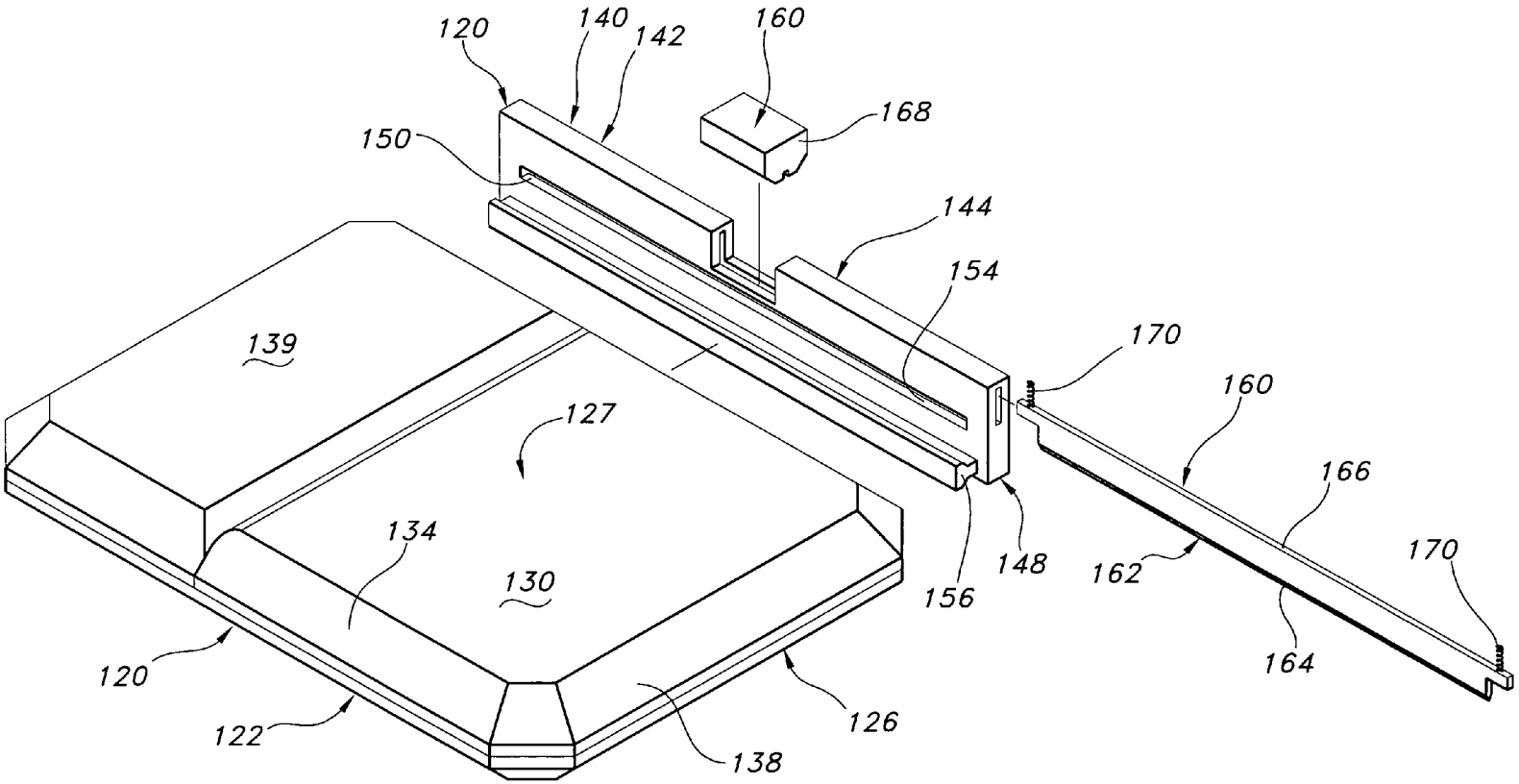
FIG. 15 is an exploded view of the sliding cutter showing the base and cutter structures.

The sliding cutter 140 includes a pair of return springs 170 which are connected to the guide structure 144 and blade structure 162, as shown in FIGS. 11 and 15. The return springs 170 resist displacement of the blade structure 162 from the open position to the cut position.

The dispenser assembly 120 is included in a kit which includes one or more pouches or packet structures 172 which are stored in the cavity 124. The cavity 124 has a sufficient dimension such that the one or more packet structures 172 may be stored therein. Each of the packet structures 172 includes an envelope structure 174 which has an interior cavity in which a strip structure is contained. Each of the packet structures 172 has opposing side layers between which the cavity of the packet structure is located. Each of the side layers has an inner liner and an outer layer which provides the packet structures 172 with a quadra-layer structure. The inner liner of the packet structures 172 may be formed of a metallic foil material.

The outer layers of the packet structures 172 are formed of a material which resists tearing by a tear force which is below a specific magnitude. The specific magnitude of the tear force is sufficiently large such that the packet structures 172 are child-resistant. The material of the outer layers of the packet structures 172 may be severed by a suitable instrument, such as the sliding cutter 140.

Figure 12:
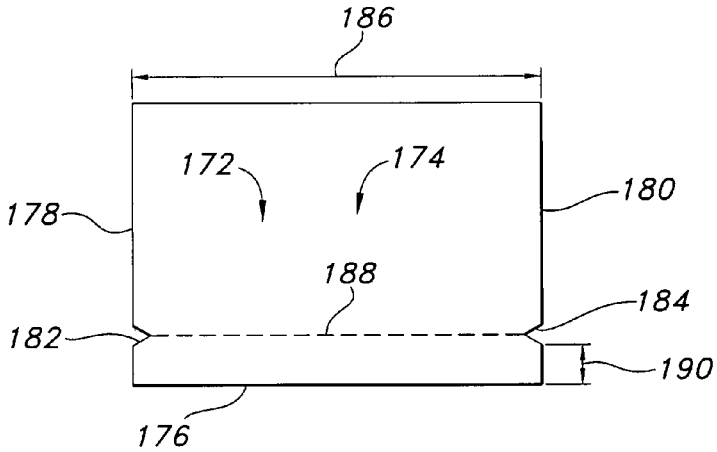
FIG. 12 is a front view of one of the packet structures located in the dispenser assembly of FIG. 8.

The envelope structure 174 has an opening edge 176 and a pair of lateral edges 178, 180 which intersect the opening edge. Each of the packet structures 172 has a locator structure connected to the envelope structure 174. The locator structure shown in FIG. 12 is defined by a pair of chevron structures 182, 184 each of which is integral with a respective one of the lateral edges 178, 180. The chevron structures 182, 184 reduce the longitudinal dimension 186 of the cavity of the corresponding packet structure 172 to a size which is smaller than the corresponding dimension of the strip structure which is stored within the packet structure. Consequently, the strip structure is obstructed from translating laterally within the packet structure 172 to a section 188 thereof which is between the chevron structures 182, 184. This maintains a lateral clearance between the strip structure and opening edge 176 which is at least as large as the lateral dimension 190 between each of the chevron structures 182, 184 and the opening edge.

The packet structures 172 have indicia on the outer surface of one or both of the outer layers. The indicia are located near the chevron structures 182, 184. The indicia indicate the alignment of the chevron structures 182, 184 relative to the blade structure 162 when the cutter structure 160 is displaced from the open to cut positions.

Figure 14:
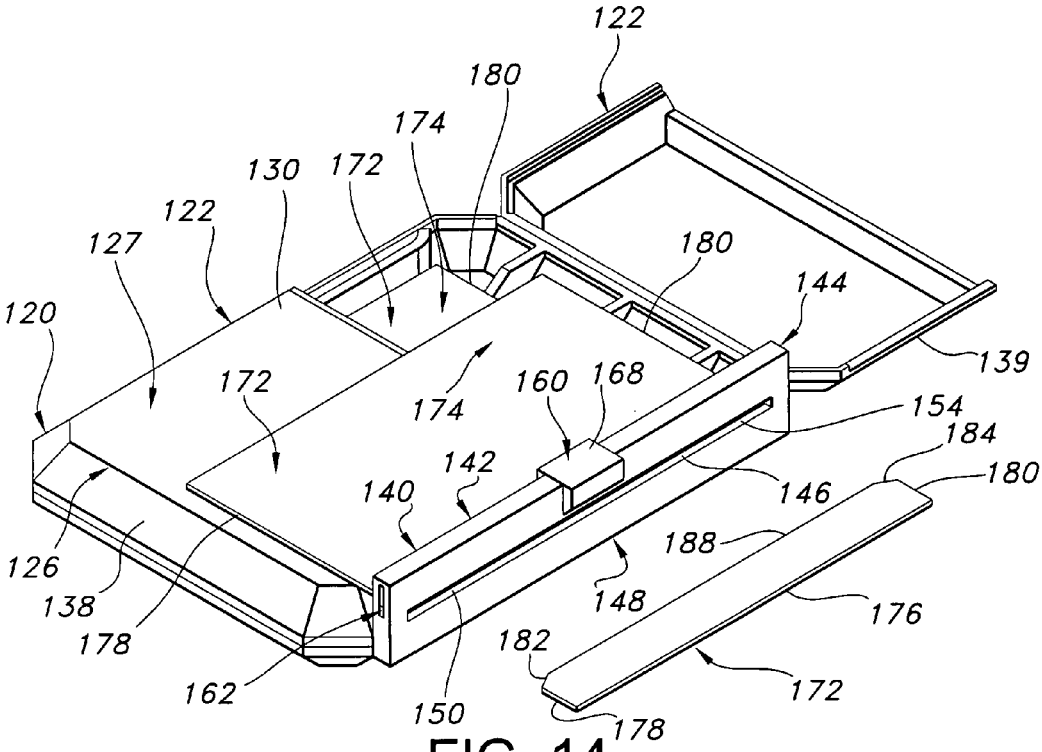
FIG. 14 is a perspective view of the dispenser assembly and packet structure of FIG. 13 following the severing of the packet structure by the sliding cutter.

The opening edge 176 is severed by the sliding cutter 140, as shown in FIG. 14, to provide access to the strip structure within the cavity of the envelope structure 174. The severing is provided by initially positioning the cutter structure 160 in the open position relative to the guide structure 144, as shown in FIG. 13. The cutter structure 160 is located in the open position by releasing the tab structure 168 such that the return springs 170 force the blade structure 168 to the open position.

The packet structure 172 is then located relative to the frame structure 142 and cutter structure 160, as shown in FIG. 13. In this position, the packet structure 172 is placed flat on the cut surface 150 such that the packet structure is perpendicular to the direction of displacement of the cutter structure 160 from the open to cut positions. Also, the frame structure 142 is located laterally between the opening edge 176 and body structure 126. This position of the packet structure 172 provides for the chevron structures 182, 184 to have substantially the same lateral positions as the blade structure 162. The indicia which are printed on the outer surface of the envelope structure 174 indicate that the packet structure 172 is positioned relative to the cutter structure 160 such that the chevron structures 182, 184 have substantially the same lateral positions as the blade structure 162.

The cutter structure 160 is then translated relative to the frame structure 142 in the direction toward the gap 151 between the front and rear sections of the cut surface 150 by depressing the tab structure 168 sufficiently to overcome the resistance of the return springs 170. The translation of the cutter structure 160 is sufficient for the blade structure 162 to cut through the packet structure 172. The cutting edge 164 initially contacts substantially the entire section 188 of the packet structure 172 contemporaneously as a result of the lateral position of the chevron structures 182, 184 being substantially the same as the blade structure 162. The continuation of the translation of the cutter structure 160 toward the gap 151 results in the cutting edge 164 traveling through the entire thickness of the section 188 contemporaneously such that the sliding cutter 140 defines a guillotine cutter. This translation of the cutter structure 160 severs the opening edge 176 from the packet structure 172. After completion of the severing, the cutting edge 164 is located within the gap 151, as shown in FIGS. 10 and 11. This defines the cut position of the cutter structure 160, as shown in FIG. 14. Also following completion of the severing, the opening edge 176 is completely separated from the packet structure 172 to allow removal of the opening edge through the evacuation port 146 and from the frame structure 142, as shown in FIG. 14. The removal of the opening edge 176 through the evacuation port 146 reduces the possible accumulation of opening edges 176, which have been severed from respective packet structures 172, in the clearance 154.

The alternative embodiment of the evacuation port 146 defined by the slit or opening which is formed in the base structure 148 and extends downward from the front and rear sections of the cut surface 150 to the bottom surface of the base structure provides for the opening edge 176, which has been severed from the packet structure 172, to drop through the slits or openings under the force of gravity. This provides for the removal of the opening edge 176 from the frame structure 142 which reduces the possible accumulation of opening edges 176, which have been severed from respective packet structures 172, in the clearance 154.

The severing of the opening edge 176 from the packet structure 172 by the cutter structure 160 provides for the strip structure which is within the envelope structure 174 to not be contacted by the blade structure 162. This is provided by the chevron structures 182, 184 which obstruct the strip structure from translating laterally within the packet structure 172 to the section 188 which is cut by the blade structure 162. Consequently, the chevron structures 182, 184 provide for the maintenance of a lateral clearance between the strip structure and opening edge 176 which is at least as large as the lateral dimension 190. This provides a minimum clearance between the strip structure and opening edge 176.

The sliding cutter 140 is preferably child-resistant such that children would normally be unable to sever a packet structure 172 using the sliding cutter. The child-resistance may be provided by configuring the sliding cutter 140 such that a child would normally be unable to properly position the packet structure 172 relative to the sliding cutter, as shown in FIG. 13. Also, the child-resistance may be provided by configuring the sliding cutter 140 such that a child would normally be unable to translate the cutter structure 160 from the position thereof shown in FIG. 13 to the position of the cutter structure 160 shown in FIG. 14 to sever the opening edge 176 from the packet structure 172.

After the opening edge 176 is completely severed from the packet structure 172, the packet structure is removed from the sliding cutter 140 and opened to remove the strip structure from within the envelope structure 174. The strip structure may be digestible and impregnated with a pharmaceutical substance for ingestion by the user. Alternatively, the strip structure may be impregnated with a medication for application to a cut or wound on the skin.

In an alternative embodiment of the dispenser assembly 120, the sliding cutter 140 may provide for the severing of the lateral edges 178, 180 from the packet structure 172.

In an alternative embodiment of the dispenser assembly 120, the frame structure 142 is secured to the side surfaces 134. In a further alternative embodiment of the dispenser assembly 20, the frame structure 142 is secured to the bottom surfaces 138.

In an alternative embodiment of the packet structure 172, the opposing sides thereof may be homogeneous such that the packet structure is a bi-layer structure.

Figure 16:
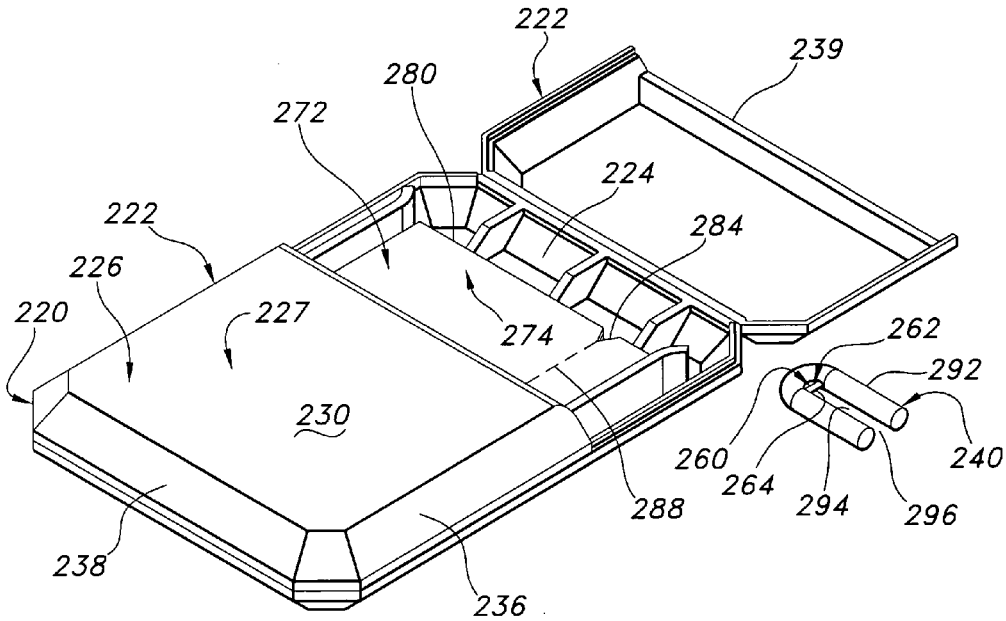
FIG. 16 is a perspective view of an alternative third embodiment of the dispenser assembly of FIG. 1, the dispenser assembly being shown as having a container structure in which are stored packet structures which contain film strips.
Figure 17:
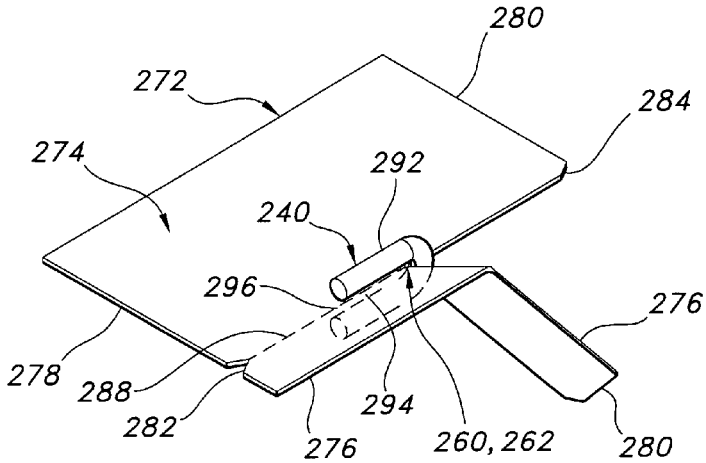
FIG. 17 is a perspective view of the dispenser assembly and packet structure of FIG. 16 showing the severing of the packet structure by the handheld cutter.

An alternative embodiment of the dispenser assembly 220 is shown in FIGS. 16 and 17. Parts illustrated in FIGS. 16 and 17 which correspond to parts illustrated in FIGS. 8 to 15 have, in FIGS. 16 and 17, the same reference numeral as in FIGS. 8 to 15 with the increase by "100" of the reference numeral in FIGS. 8 to 15. For example, the container structure 222 in FIG. 16 corresponds to the container structure 122 in FIGS. 8 to 11, and 13 to 15.

The dispenser assembly 220 includes a handheld cutter 240 which is removably stored, with the packet structures 272, in the container structure 222. Removal of the handheld cutter 240 from the container structure 222 is shown in FIG. 16.

The handheld cutter 240 includes a frame structure 242 having a U-shaped member 292 within which is defined an interior region 294 such that the interior region is planar and partially enclosed by the U-shaped member. The U-shaped member 292 has ends between which is defined a gap region 296.

The handheld cutter 240 includes a cutter structure 260 having a blade structure 262. The blade structure 262 has a cutting edge 264 which is sharpened for cutting. The blade structure 262 is connected to the U-shaped member 292 such that the blade structure is located within the interior region 294 in coplanar relation thereto. The blade structure 262 is oriented relative to the U-shaped member 292 such that access to the cutting edge 264 is provided by the gap region 296. Access to the cutting edge 264 is limited by the U-shaped member 292.

With the handheld cutter 240 removed from the container structure 222, the opening edge 276 is severed by the blade structure 262, as shown in FIG. 17, to provide access to the strip structure within the cavity of the envelope structure 274. The severing is provided by initially positioning the handheld cutter 240 to have substantially the same lateral position as the chevron structure 284, as shown in FIG. 17. The handheld cutter 240 is further positioned such that the section 288 of the packet structure 272 which is adjacent to the chevron structure 284 is within the interior region 294. The further positioning of the handheld cutter 240 orients the legs of the U-shaped member 292 to extend in the direction of the chevron structure 282 and the blade structure 262 to be generally perpendicular to the packet structure 272.

The handheld cutter 240 is displaced longitudinally relative to the packet structure 272 such that the cutting edge 264 initially contacts the section 288 at the intersection thereof with the chevron structure 284. The displacement the handheld cutter 240 is continued such that the cutting edge 264 severs the section 288 progressively in the direction toward the chevron structure 282, as shown in FIG. 17. The chevron structures 282, 284 obstruct the strip structure which is within the envelope structure 274 from translating laterally within the packet structure 272. Consequently, the strip structure is not contacted by the blade structure 262 in a manner which corresponds to the strip structure which is within the envelope structure 174 not being contacted by the blade structure 162 as a result of the chevron structures 182, 184.

The displacement of the handheld cutter 240 is completed by displacing the blade structure 262 sufficiently such that the cutting edge 264 reaches the chevron structure 282 and cuts through the intersection thereof with the section 288. Subsequently, the opening edge 276 is completely separated from the packet structure 272. The complete separation of the opening edge 276 from the packet structure 272 allows the removal of the strip structure from within the envelope structure 274 in a manner which corresponds to the removal of the strip structure from the envelope structure 174.

The handheld cutter 240 is displaced by being held between the fingers and thumb of one hand of the user. The initial positioning of the handheld cutter 240 at the chevron structure 282 may be facilitated by indicia on one or both of the outer layers of the packet structure 272 which indicate the correct orientation of the handheld cutter 240, including the blade structure 262, relative to the section 288. Alternatively, the handheld cutter 240 may be initially positioned at the chevron structure 282 of a packet structure 272 which does not include the indicia.

An alternative method of the severing of the packet structure 272 by the handheld cutter 240 provides for the cutting to be initiated at the chevron structure 282. This method further provides for the section 288 to be severed progressively in the direction toward the chevron structure 284, in a manner which corresponds to the severing of the section 288 shown in FIG. 17. The handheld cutter 240 is displaced by being held between the fingers and thumb of one hand of the user. The initial positioning of the handheld cutter 240 at the chevron structure 282 may be facilitated by indicia on one or both of the outer layers of the packet structure 272, in a manner which corresponds to the initial positioning of the handheld cutter 240 at the chevron structure 284. Alternatively, the handheld cutter 240 may be initially positioned at the chevron structure 284 of a packet structure 272 which does not include the indicia.

An alternative embodiment of the handheld cutter 240 is constituted by a cutter assembly which corresponds to the cutter structure defined by the cutter assembly 42 shown in FIGS. 1 to 4, 6, and 7. A further alternative embodiment of the handheld cutter 240 is constituted by a sliding cutter which corresponds to the sliding cutter 140 shown in FIGS. 8 to 11, and 13 to 15. A further alternative embodiment of the handheld cutter 240 is constituted by a laser cutter. The alternative embodiments of the handheld cutter 240 are each removably stored in the container structure 222 with the packet structures 272, such that the respective handheld cutters are removed from the container structure for the severing of the sections 288.

While the invention has been described by reference to certain preferred embodiments, it should be understood that numerous changes could be made within the spirit and scope of the inventive concept described. Accordingly, it is intended that the invention not be limited to the disclosed embodiments, but that it have the full scope permitted by the language of the following claims.

What is claimed is:

1. A hand-held An assembly including a dispenser and a packet structure, said assembly comprising:

a plurality of individual packet structures each comprising a digestible film strip structure contained within said packet structure, wherein each of said packet structures comprise an envelope structure having an interior cavity in which said film strip structure is contained, said envelope structure having an opening edge which may be severed by a cutter structure to provide access to said digestible film strip structure within said cavity of said envelope structure, and each of said packet structures further comprising a locator structure connected to said envelope structure;

a container structure having an interior cavity, said cavity having a sufficient dimension such that the packet structure may be stored therein;

said container comprising a top and a bottom surface, said top surface comprising a hinged cap structure for opening and closing said container; and a cutter structure secured along a side portion of said container and positioned to allow unobstructed movement of said hinged cap structure and a cutter assembly including a guide structure for holding said packet structure in a planar position and for guiding movement of a blade structure in a linear movement, said guide structure including a gap for translation of said blade structure, wherein said cutter structure comprises a support structure which is fixed to said container structure, said cutter structure further comprising a slider structure which is connected to said support structure such that said slider structure may be translated relative to said support structure to sever the packet structure.

2. An assembly according to claim 1, wherein said container structure has an outer surface, said cutter structure being secured to said outer surface.

3. A dispenser assembly according to claim 1, wherein said container structure comprises a body structure and a cap structure which is removably connected to said body structure to provide access to said cavity, said support structure being elongate and extending to said cap structure.

4. A kit comprising an assembly according to claim 1, each of said packet structures being formed of a material which resists tearing by a tear force which is below a specific magnitude, said material being severable by said cutter structure.

5. A kit according to claim 4, wherein said specific magnitude of said tear force is sufficiently large such that said each of said packet structures are child-resistant.

6. A dispenser assembly according to claim 1, wherein said digestible film strip structure is impregnated with a pharmaceutical substance.

7. A dispenser assembly according to claim 1, wherein said locator structure indicates maintains a minimum clearance between said digestible film strip structure and said opening edge.

8. A dispenser assembly according to claim 7, wherein said envelope structure has a pair of lateral edges which intersect said opening edge, said locator structure comprising a pair of chevron structures each of which is integral with a respective one of said lateral edges such that a lateral dimension between each of said chevron structures and said opening edge is at least as large as said minimum clearance.

* * * * *